US011812864B2

(12) United States Patent
Fornasarig

(10) Patent No.: US 11,812,864 B2
(45) Date of Patent: Nov. 14, 2023

(54) CHAIR

(71) Applicant: Luca Fornasarig, San Giovanni al Natisone (IT)

(72) Inventor: Luca Fornasarig, San Giovanni al Natisone (IT)

( * ) Notice: Subject to any disclaimer, the term of this patent is extended or adjusted under 35 U.S.C. 154(b) by 151 days.

(21) Appl. No.: 17/427,196

(22) PCT Filed: Jan. 30, 2020

(86) PCT No.: PCT/IT2020/050014
§ 371 (c)(1),
(2) Date: Jul. 30, 2021

(87) PCT Pub. No.: WO2020/157783
PCT Pub. Date: Aug. 6, 2020

(65) Prior Publication Data

US 2022/0142370 A1 May 12, 2022

(30) Foreign Application Priority Data

Jan. 31, 2019 (IT) ..... 102019000001445

(51) Int. Cl.
*A47C 3/04* (2006.01)
*A47C 4/02* (2006.01)
*A47C 4/03* (2006.01)
*A47C 5/04* (2006.01)

(52) U.S. Cl.
CPC ..... *A47C 3/04* (2013.01); *A47C 4/02* (2013.01); *A47C 4/03* (2013.01); *A47C 5/04* (2013.01)

(58) Field of Classification Search
CPC .... A47C 3/04; A47C 4/02; A47C 4/03; A47C 5/04; A47C 5/10; A47C 5/046; A47C 7/42
USPC ..... 297/239, 440.1, 440.13, 440.14, 440.2, 297/440.23, 446.1, 447.3, 447.4, 448.2
See application file for complete search history.

(56) References Cited

U.S. PATENT DOCUMENTS 1,375,868 A * 4/1921 Thompson ..... A47C 7/42 5/59.1
2,306,878 A * 12/1942 Greitzer ..... A47C 5/06 297/440.21
2,668,584 A * 2/1954 Greitzer ..... A47C 3/023 403/329
3,003,817 A * 10/1961 King ..... A47C 4/02 297/440.22
3,080,194 A * 3/1963 Rowland ..... A47C 3/04 297/239

(Continued)

FOREIGN PATENT DOCUMENTS

CN 2629546 Y 8/2004
FR 1065990 A 6/1954

(Continued)

OTHER PUBLICATIONS

PCT Search Report & Written Opinion for PCT/IT2020/050014, dated Mar. 26, 2020, 11 Pages.

*Primary Examiner* — Robert Canfield
(74) *Attorney, Agent, or Firm* — Maine Cernota & Curran

(57) ABSTRACT

A chair comprising two facing and cooperating sidepieces (11), bar-type connection means to correctly and stably distance the two sidepieces (11), and, during use, a backrest (13) and a seat (12); the bar-type connection means, the backrest (13) and the seat (12) connect the two sidepieces (11) transversely in a stable manner.

16 Claims, 3 Drawing Sheets

(56) References Cited

U.S. PATENT DOCUMENTS 3,273,922 A * 9/1966 Rasor ..... A47C 3/04 297/450.1
3,278,227 A * 10/1966 Rowland ..... A47C 1/124 297/239
3,446,530 A * 5/1969 Rowland ..... A47C 7/54 297/239
3,677,601 A * 7/1972 Morrison ..... A47C 7/18 297/452.17
3,734,561 A * 5/1973 Barecki ..... A47C 3/00 297/DIG. 2
3,874,729 A * 4/1975 Blodee ..... A47C 4/022 297/452.48
3,999,802 A * 12/1976 Powers ..... A47C 5/046 297/239
D246,813 S * 1/1978 Tolleson ..... D6/373
4,097,089 A * 6/1978 Petersen ..... A47C 4/02 297/451.7
4,522,444 A * 6/1985 Pollock ..... A47C 3/021 297/440.11
4,648,653 A * 3/1987 Rowland ..... A47C 3/04 297/239
4,852,944 A * 8/1989 Hartmann ..... A47C 5/04 297/411.42
4,938,530 A * 7/1990 Snyder ..... A47C 3/023 297/287
D321,994 S * 12/1991 Scheper ..... D6/373
5,649,742 A * 7/1997 Liu ..... A47C 5/10 297/440.22
6,033,026 A * 3/2000 Tseng ..... A47C 4/03 297/452.4
D423,805 S * 5/2000 Olson ..... D6/373
6,109,696 A * 8/2000 Newhouse ..... A47C 7/42 297/452.21
7,513,567 B2 * 4/2009 Huang ..... A47C 4/20 297/440.2
7,775,600 B2 * 8/2010 Battey ..... A47C 7/32 297/440.15
8,851,561 B2 * 10/2014 Huang ..... A47C 4/24 297/23
9,161,629 B2 * 10/2015 Huang ..... A47C 3/04
2012/0228917 A1 * 9/2012 Huang ..... A47C 3/00 297/446.2
2015/0196124 A1 7/2015 Ballendat
2015/0374131 A1 * 12/2015 Kim ..... A47C 4/42 297/440.1
2016/0051053 A1 2/2016 Scagnellato

FOREIGN PATENT DOCUMENTS

JP 3167526 U 4/2011
JP 2013-13506 * 1/2013

* cited by examiner

CHAIR

RELATED APPLICATIONS

This application is a national phase application filed under 35 USC § 371 of PCT Application No. PCT/IT2020/050014 with an International filing date of Jan. 30, 2020, which claims priority of IT Patent Application 102019000001445 filed on Jan. 31, 2019. Each of these applications is herein incorporated by reference in its entirety for all purposes.

FIELD OF THE INVENTION

The present invention concerns a perfected chair.

More particularly it concerns a chair, or more generally seating elements, the frame of which is made with a tube or round piece made of iron, or steel, and to which a seat and a backrest are applied. The seat and the backrest can be separated or in a single body.

BACKGROUND OF THE INVENTION

The present invention is intended to overcome the current state of the technology for the production of this type of chair.

Normally these chairs have two substantially identical sides, with the base(s) creating at least one closed polygon, and, for to their stability, they require at least two transverse connection bars that firmly join the sides.

This technology entails cost problems and transport and storage problems.

Storage is very important during the production step and where there is a multitude of chairs that have to be stacked for transport, temporary or non-temporary storage and cleaning activities.

Furthermore, during the storage of known chairs, for example by stacking them, damage can be caused both to the frame and also possibly to the seat and/or to the backrest.

In current competitive frameworks, and for those that are expected, the two problems identified entail both economic and management situations that are increasingly unsustainable.

The Applicant has therefore set itself the target of overcoming these disadvantages and of producing a chair that is stable, costs less and which can be managed very easily in terms of storage and transport.

Furthermore it is also a purpose of the present invention to provide a chair which can be managed in a disassembled condition and which can be easily assembled obtaining a chair that is stable, aesthetically pleasing and possibly easy to store.

The Applicant has studied, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the invention or variants to the main inventive idea.

In accordance with the above purposes, a chair in accordance with the present invention comprises two facing and cooperating sidepieces, bar-type connection means to correctly and stably distance the two sidepieces, and, during use, a backrest and a seat.

The sidepieces and the bar-type connection means define the frame of the chair.

According to the invention, the bar-type connection means, the backrest and the seat as above connect the two sidepieces transversely in a stable manner.

The sidepieces each normally have an element or an upright cooperating during use with the backrest and a lower part or support structure, designated to support and position the actual seating element, that is the seat, which normally has a closed polygon conformation.

According to another aspect of the invention, the chair can be dismantled and easily stacked.

According to another aspect of the invention, the bar-type connection means comprise a single connection bar.

According to a first embodiment, the two sidepieces are stably connected and made reciprocally integral, by means of a connection bar welded to the respective sidepieces.

According to a variant, the connection bar can be disassembled by means of connection means so as to simplify storing and transporting the chair.

According to one embodiment, the chair is provided with:

first engagement/disengagement means to associate or disassociate the backrest with/from the sidepieces, second engagement/disengagement means to associate or disassociate the seat with/from the sidepieces.

Each sidepiece can have one upright that can be associated with the backrest.

Each upright is provided with the first engagement/disengagement means as above suitable to cooperate with the backrest at the moment of connection.

The first means stabilize the reciprocal connection between the backrest and the sidepieces so as to make it stable and long lasting over time.

The first engagement/disengagement means have fixed elements in the backrest which cooperate with one or more mating elements present in the upright and which autonomously generate a stable connection. In this way the backrest can be assembled or disassembled onto/from the sidepieces easily and quickly.

According to a variant, there can also be provided a connection able to be stabilized by means of a screw, or an expansion pin, or of another type, with the aim of cooperating with the first engagement/disengagement means and at the same time make the backrest able to be disassembled.

According to the invention, the second engagement/disengagement means comprise connection plates, of the know type, provided on the sidepieces which are used to stably apply the seat or the seating plane to the sidepieces.

Furthermore, the engagement/disengagement means advantageously allow to prevent damage occurring to the chairs, in particular at the frame level, when storing the same chairs without the seat, for example stacking them.

According to a variant of the invention, the connection plates have a shaping which allows the application of a covering and protection element.

The covering element, as well as preventing a person who is sitting on the chair from hurting his/her fingers, also fulfills other functions. It performs a decorative function, preventing the connection plate from being seen.

It also performs the function of protecting the surface of the seat on which a chair is stacked on top. In fact the covering element rests on the seat of the chair below preventing the surface of the seat from being ruined by the connection plate.

According to one embodiment of the invention, the covering elements are connected to the connection plates in a selectively releasable manner by means of snap-on coupling.

In this way, advantageously, the covering elements, once associated with the connection plates, cannot be accidentally removed during transport or storage operations but only deliberately with the intervention of, for example an operator.

BRIEF DESCRIPTION OF THE DRAWINGS

These and other characteristics of the present invention will become apparent from the following description of some embodiments, given as a non-restrictive example, with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

We will now refer in detail to the various embodiments of the present invention, of which one or more examples are shown in the attached drawings. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

Figure 2:
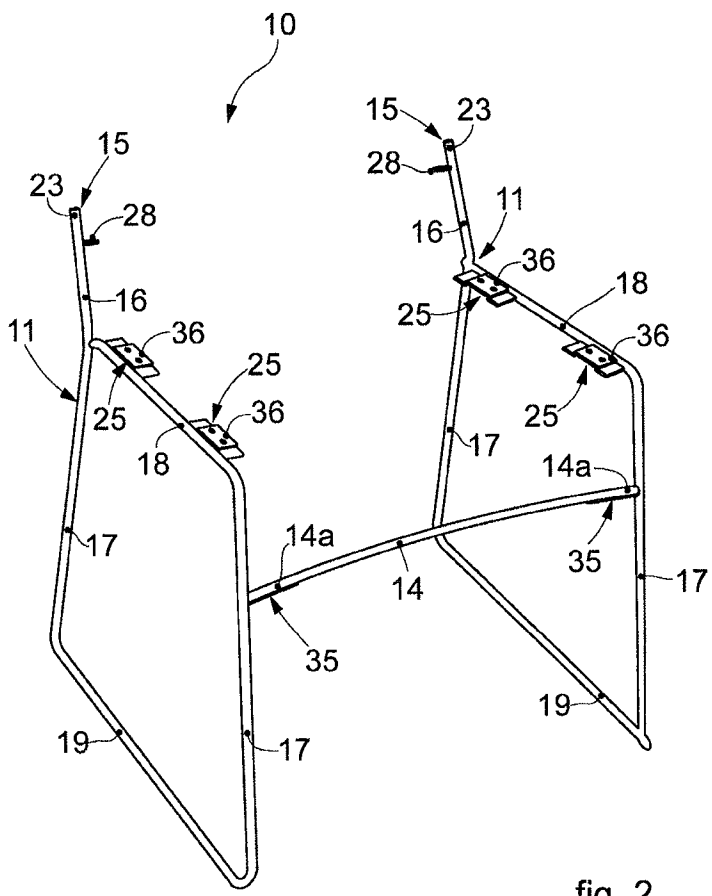
FIG. 2 is a perspective view of the chair of FIG. 1 without backrest and seat.
Figure 1:
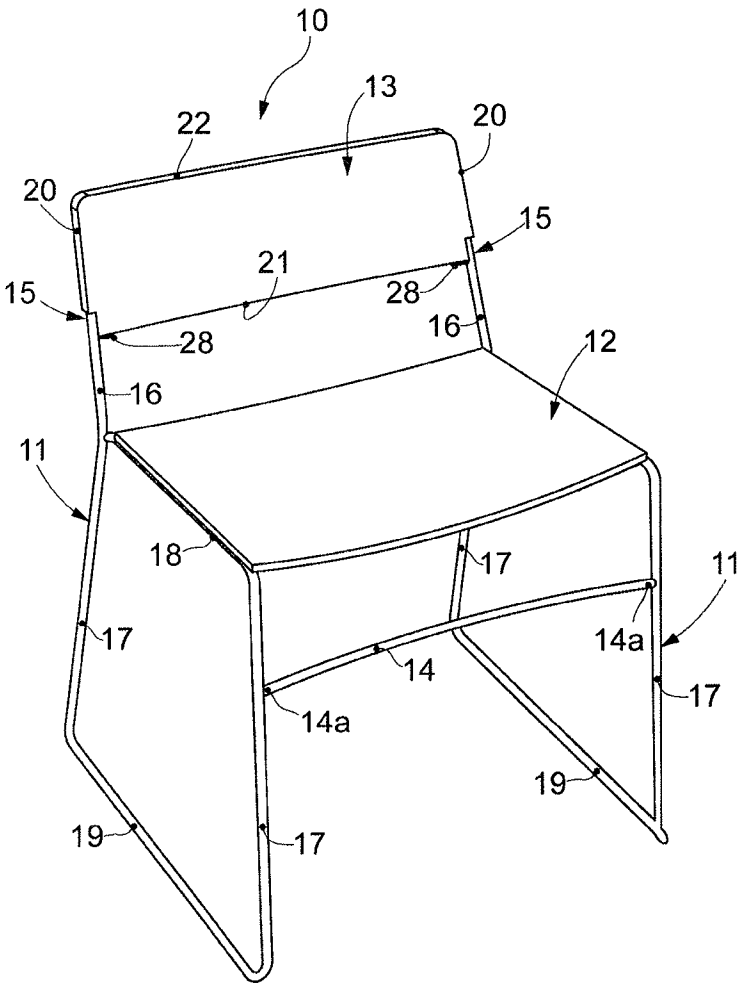
FIG. 1 is a perspective view of a chair in accordance with the present invention.

With reference to FIGS. 1-2, a chair 10 comprises at least two facing and cooperating sidepieces 11, bar-type connection means to correctly and stably distance the two sidepieces 11, and, during use, a backrest 13 and a seat 12.

The backrest 13 and the seat 12 connect the two sidepieces 11 transversely in a stable manner.

The seat 12 and backrest 13 can be separated or in a single body.

The seat 12 and backrest 13 can be made of metal, or partly of metal, or of wood or plastic.

According to the invention, the chair 10 can advantageously be dismantled. Consequently the chair 10 is easy to store and transport in a small space and at a lower cost.

According to the invention, the bar-type connection means comprise a single connection bar 14.

The sidepiece 11 can have a frame made with a round piece or tube made of iron, or steel, to which the seat 12 and the backrest 13 are applied.

Each sidepiece 11 is provided with an upright 16 suitable for the connection with the backrest 13.

In particular, each upright 16 is provided with an upper end 23 able to be associated with the backrest 13.

According to one embodiment, the upright 16 can be a bar or a metal round piece of different shapes and sizes depending on the type of chair 10 to be obtained and depending on the aesthetic characteristics thereof.

Each sidepiece 11 is also provided with a support structure 17, 18, 19 associated with the upright 16 and normally conformed as a closed polygon.

The support structure 17, 18, 19 can comprise at least two legs 17 per sidepiece 11 suitable for the chair 10 to rest and be supported on a support plane and one or more crosspieces 18,19.

The legs 17 of one sidepiece 11 are connected to each other by means of at least a first crosspiece 18 suitable to support the seat 12.

The legs 17 of one sidepiece 11 can be connected to each other by means of several crosspieces 18, 19.

These crosspieces 18, 19 can be disposed with the legs 17 possibly defining the closed polygon as above.

This closed polygon can be rectangular, trapezoidal or square, or any other shape whatsoever depending on the aesthetic characteristic to be given to the chair 10.

We do not exclude that the support structure 17, 18, 19 is a panel or a flat sheet, or concave, or convex, or inclined or having any other shape whatsoever depending on the aesthetic characteristic to be given to the chair 10.

The first crosspiece 18 can be connected directly to the upright 16.

The upright 16 and, consequently, the backrest 13 can be disposed inclined with respect to the first crosspiece 18 and to the seat 12 at an angle such as to support the back of a user in an ergonomic and comfortable manner.

According to one embodiment, the first crosspieces 18 of the two sidepieces 11 can advantageously be arch-shaped in order to adapt to the characteristic of the sidepiece 11 at the point of connection with the seat 12.

According to one embodiment, the sidepiece 11 can advantageously be made in a single body.

According to one embodiment, the sidepiece 11 can be made with a single metal section bar to define the upright 16 and the support structure 17, 18, 19. For example the support structure 17, 18, 19, made with a single section bar, could have a trapezoidal shape with the smaller base corresponding to the first crosspiece 18 and the larger base corresponding to another crosspiece 19 parallel to the first crosspiece 18.

In this way it is possible to obtain a light and aesthetically pleasing sidepiece 11 without welds or other attachment means, for example screws, between the upright 16 and the support structure 17, 18, 19 or inside the support structure 17, 18, 19 itself. Furthermore such a sidepiece 11 requires less materials and workings in the production step obtaining a chair 10 which is inexpensive and at the same time with good aesthetic characteristics.

According to the invention, the uprights 16 of the lateral sidepieces 11 end in a desired relative position in relation to the backrest 13.

The shape and sizes of the backrest 13 can be of various types, however they have to reasonably provide to accommodate and support a user's back.

Furthermore, the backrest 13 is provided with two opposite sides 20 configured to be associated with the respective uprights 16 of the sidepieces 11, with a lower side 21 facing the seat 12 and with an upper side 22 opposite the lower side 21.

The seat 12 can also be of various shapes and sizes depending on the comfort of the user and the overall aesthetics of the chair 10.

According to one embodiment, the connection bar 14 is made integral with one side of the sidepiece 11 so as to connect and support the facing sidepieces 11 in a vertical position.

In particular, the connection bar 14 is provided with diametrically opposite front terminal parts 14*a* each associated with a sidepiece 11 so as to connect the sidepieces 11 transversely.

Figure 7:
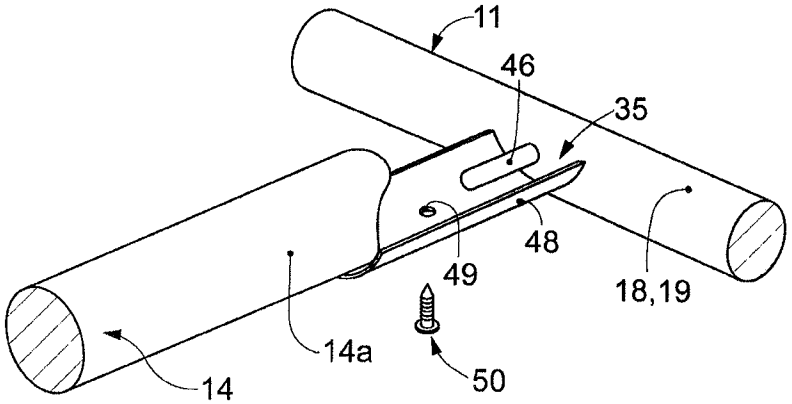
FIG. 7 is a perspective view of another detail of the chair of FIG. 1.

According to another embodiment, the connection bar 14 can be made integral with a crosspiece 18, 19 (FIGS. 7, 7*a*) of the sidepiece 11 advantageously allowing a correct and stable distancing of the sidepieces 11.

According to another embodiment, the connection bar 14 can be made integral with a leg 17 of the sidepiece 11 (FIG. 1, 2) connecting the two sidepieces 11 transversely and integrally in order to define the overall frame of the chair 10.

According to another embodiment, the connection bar 14 can be welded to the sidepiece 11 so as to be stably and securely constrained to both the facing sidepieces 11. This solution is particularly useful in the event a quick assembly is required.

According to another embodiment, the connection bar 14 can be disassembled from the sidepiece 11 so as to reduce the bulk during the storage and transport step.

According to one embodiment, the chair 10 is provided with connection means 35 (FIGS. 2, 7-8) present in the sidepieces 11 suitable to associate or disassociate the connection bar 14 with/from the sidepieces 11.

According to a variant, the connection means 35 comprise an axial hole 45 provided in each opposite end of the connection bar 14 and a peg 46 or pin provided specular on both sidepieces 11 and configured to cooperate with the axial hole 45.

According to some variants, the peg 46 can be welded, or fitted, or screwed, or attached in another manner to the sidepiece 11.

According to one embodiment, the peg 46 of one sidepiece 11 is provided protruding toward the opposite sidepiece 11 and aligned with the specular peg 46 of the opposite sidepiece 11 so as to guarantee the correct assembly of the connection bar 14 transversely to the sidepieces 11.

The front terminal parts 14*a* of the connection bar 14 are, advantageously shaped to adapt to the characteristic of the sidepiece 11 at the point of connection. For example, with reference to FIG. 7*a*, they can be arch-shaped.

According to a variant, the connection means 35 comprise a support element 48 protruding from each sidepiece 11, configured to facilitate and support the connection of the connection bar 14 to the sidepieces 11 and provided with stable clamping means 50 to constrain the connection as above.

The support element 48 can be associated with the peg 46.

According to one embodiment, the support element 48 can be a flat extension such as to support the connection bar 14.

According to another embodiment, the support element 48 can be a concave saddle with a shape mating with the connection bar 14.

According to another embodiment, the support element 48 can be a concave tubular element, containing the peg 46, and configured to accommodate and surround the front terminal part 14*a* of the connection bar 14.

The support element 48 can be constrained to the sidepiece 11 by mechanical attachment means, for example screws, or by means of a joint.

The support element 48 can be welded to the upright 16.

The support element 48 can be provided with at least one through aperture 49. This through aperture 49 can be a through hole possibly threaded.

The connection bar 14 can be provided, at each end, with at least one transverse hole 47.

The transverse hole 47 can be blind. The transverse hole 47 can be threaded.

Figure 7A:
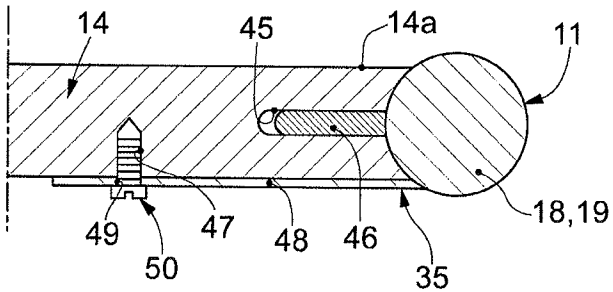
FIG. 7*a* is a section view of the detail of FIG. 7.

According to one embodiment, the through aperture 49 is configured to be aligned with the transverse hole 47 of each end of the connection bar 14 in the assembly step (FIG. 7*a*). In this way the connection bar 14 can be constrained to the support element 48 by means of the clamping means 50 as above, for example by means of a clamping screw.

According to one aspect of the invention, the chair 10 is provided with first engagement/disengagement means 15 (FIGS. 2-5) in order to associate or disassociate the backrest 13 with/from the sidepieces 11.

According to one embodiment, the first engagement/disengagement means 15 have fixed elements 27, 33, 34 in the backrest 13 which cooperate with one or more mating elements 26, 28, 39 present in at least one upright 16 of each sidepiece 11 and suitable for connection with the fixed elements 27, 33, 34.

According to one embodiment, the fixed elements 27, 33, 34 can comprise a pin 27 provided facing downward on each side 20 of the backrest 13. This side 20 is suitable to cooperate with the upright 16.

According to one embodiment, the mating elements 26, 28, 39 can comprise an axial hole 26 provided at the top of each upright 16, that is in the upper end 23, and configured to be selectively coupled with the pin 27. According to some variants, the pin 27 can be fitted, or screwed, or attached with other attachment means to the backrest 13.

According to one embodiment, the fixed elements 27, 33, 34 can also comprise a recess 33 provided on each side 20 of the backrest 13, in correspondence with where the upright 16 of the sidepiece 11 is located. This recess 33 is advantageously configured to accommodate and at least partly contain the upright 16.

The upper end 23 of the upright 16 is suitable to abut against an abutment surface 24 provided in the recess 33.

According to one embodiment, the pin 27 is provided protruding from the abutment surface 24 inside the recess 33 and is suitable to cooperate with the axial hole 26 present in the upper end 23 of the upright 16 of the sidepiece 11.

According to one embodiment, the recess 33 can be configured to partly or completely surround the upright 16 according to the aesthetic characteristic to be obtained.

Consequently, for example, if the upright 16 is a bar, the recess can be cylindrical, semi-cylindrical, or present at least one arched wall 33*a* (FIG. 3) to accommodate and guide the upright 16 in the assembly/disassembly step.

According to another embodiment (not shown), the mating elements 26, 28, 39 can comprise a pin provided facing upward at the top of each upright 16 and the fixed elements 27, 33, 34 can comprise a hole provided at the bottom of each side 20 of the backrest 13, said hole being configured to be selectively coupled with the pin provided on the upright 16.

The choice between the configurations described above of the mating elements 26, 28, 39 and the fixed elements 27, 33, 34, for example the choice of providing a pin (not shown) and/or an axial hole 26 on the upright 16 for coupling the sidepiece 11 with the backrest 13, depends on the type of chair in terms of sizes, aesthetic characteristics and materials and on the degree of modularity desired in order to obtain easier, safer and faster transport, storage and assembly of the chair 10 itself.

According to one embodiment, the mating elements 26, 28, 39 of the first engagement/disengagement means 15 can comprise at least one extension 28 protruding laterally from each upright 16 and configured to abut against the surface of the lower side 21 of the backrest 13 and suitable to be associated with the backrest 13.

The extension 28 can be provided with a through hole 29.

The extension 28 can be provided on the internal side of each upright 16 facing toward the other upright 16.

A blind hole 30 can be made in the lower side 21 of the backrest 13 in correspondence with the through hole 29 of the extension 28 and in alignment with the latter so as to constrain the backrest 13 to the extension 28 by means of stop means 31, for example a screw, or an expansion pin or other mechanical attachment element. The blind hole 30 can be threaded in order to allow the screwing of a screw 31.

According to a possible embodiment (not shown), the extension 28 can be defined by a bar protruding transversely to the upright 16 and configured to cooperate with a suitable aperture provided on each side 20 of the backrest 13.

According to another possible embodiment (not shown), the extension 28 can be provided with a peg or bar protruding upward, disposed transversely to the extension 28, configured to cooperate with the lower side 21 of the backrest 13.

The possible configurations of the extension 28 described above can depend on the different type of chair 10 in terms of size and materials and on the degree of disassembly thereof to be obtained.

According to one variant, in the lower side 21 of the backrest 13 a seating 32 can be provided which is suitable to accommodate and cooperate with, advantageously but not necessarily, the extension 28. In this way the extension 28 and the stop means 31 are recessed in the seating 32 preventing unaesthetic protrusions from the lower side 21 of the backrest 13.

According to one embodiment, the extensions 28 can protrude from each sidepiece 11 by a distance comprised between 1 cm and 8 cm, preferably between 2 cm and 6 cm depending on the size of the backrest 13 and, more generally, of the chair 10.

The extensions 28 can be associated with the upright 16 by means of mechanical attachment means, for example screws, or by means of a bayonet, dovetail or joint coupling.

Figure 5:
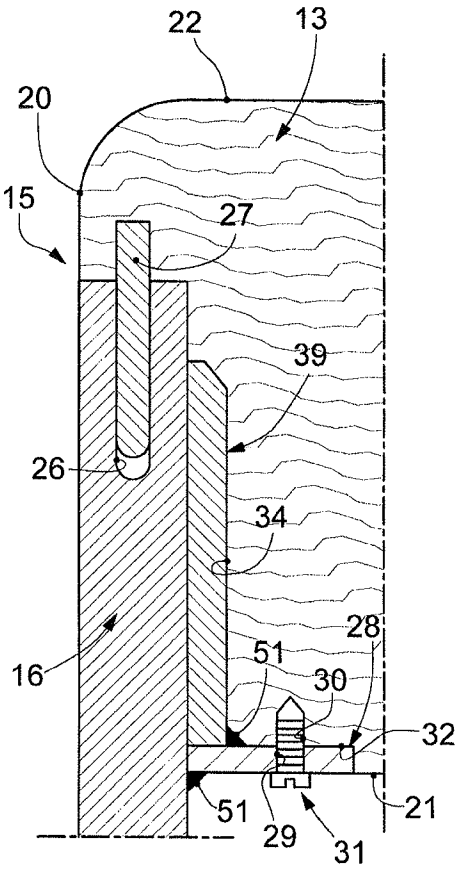
FIG. 5 is a perspective view of another detail of the chair of FIG. 1.
Figure 4:
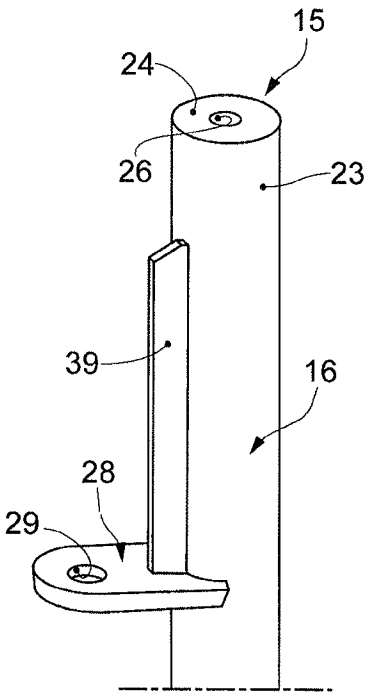
FIG. 4 is a perspective view of a detail of the chair of FIG. 2.
Figure 3:
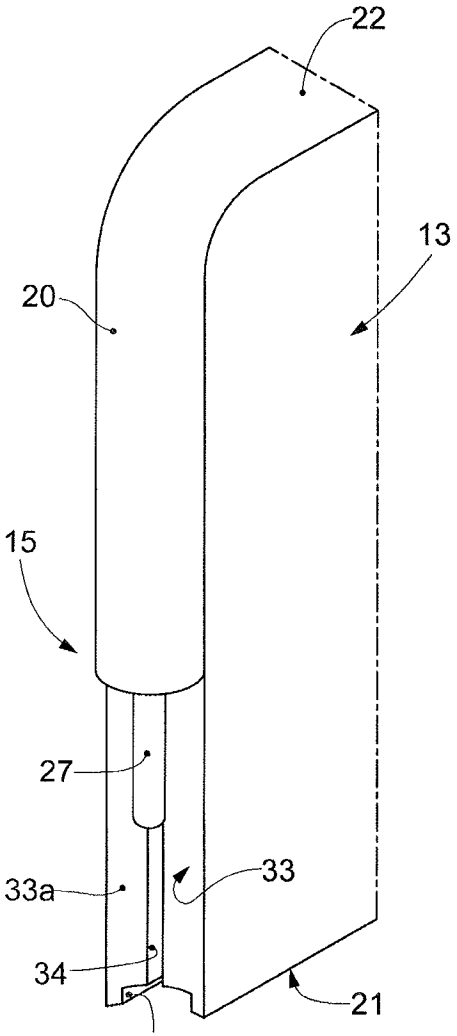
FIG. 3 is a perspective view of a detail of the backrest of the chair of FIG. 1.

As shown by way of example in FIG. 5, the extensions 28 can be welded to the uprights 16 by means of welding seams 51.

According to one embodiment, the mating elements 26, 28, 39 can comprise a protrusion 39 provided protruding from the upright 16.

According to another embodiment, the fixed elements 27, 33, 34 can comprise a groove 34 provided on each opposite lateral side 20 of the backrest 13 starting from the lower side 21 thereof. The protrusion 39 is configured to cooperate with the groove 34.

The protrusion 39 can have an oblong development parallel to the development of the upright 16.

The protrusion 39 can be oblong in shape with the upper end shaped to facilitate the insertion into the groove 34. The protrusion 39 can be, for example rectangular or semi-cylindrical.

The protrusion 39 can be defined by a plate of oblong size provided protruding laterally from the upper end 23 of the upright 16 and in a vertical position above the extension 28 and in contact with the latter.

The protrusion 39 can be provided protruding laterally and at the top from the upper end 23 of the upright 16. In this way the protrusion 39 can define the pin as above (not shown) provided facing upward at the top of the upright 16 or possibly cooperate with said pin in attaching the backrest 13 to the sidepieces 11.

According to another embodiment, the protrusion 39 can be welded to the extension 28 and to the upright 16. This solution allows to reduce the production costs and time of the chair 10.

The protrusion 39 can have a size protruding from the upright 16 smaller than the protruding size of the extension 28 so that once associated they substantially form an "L"-shaped protrusion.

The protrusion 39 can be provided on the internal side of the upright 16 of one sidepiece 11 facing the upright 16 of the other opposite sidepiece 11.

According to one embodiment, the groove 34 can be provided along the arched wall 33*a* of the recess 22 of the backrest 13.

According to one embodiment, the groove 34 has an oblong size perpendicular to the lower side 21 so as to allow the insertion of the protrusion 39.

According to another embodiment, the groove 34 has a shape and a size that allow and guide the insertion of the protrusion 39 inside it by sliding.

According to one embodiment, the assembly of the backrest 13 onto the sidepieces 11 provides that the backrest 13 is applied in such a way that the two pins 27 of the two opposite sides 20 of the backrest 13 intersect in the blind axial holes of the respective uprights 16 of the two sidepieces 11.

According to another embodiment, the assembly of the backrest 13 onto the sidepieces 11 can provide that the two protrusions 39 of the two uprights 16 slide in the grooves 34 of the two opposite sides 20 of the backrest 13. In this way the connection of the backrest 13 to the sidepieces 11 is made more stable and directed.

Once the assembly is complete (FIG. 5) the two extensions 28 present in the uprights 16 cooperate with the two seatings 32 present at the opposite ends of the lower side 21 of the backrest 13 and stop means 31, for example screws, make the whole integral.

According to one aspect of the invention, the chair 10 is provided with second engagement/disengagement means 25 (FIGS. 2, 6 and 6*a*) in order to stably associate or disassociate the seat 12 with/from the sidepieces 11.

According to one embodiment, the second engagement/disengagement means 25 comprise connection plates 36 provided on the sidepieces 11 and able to be used to apply the seat 12 stably and correctly.

These connection plates 36 can protrude laterally from the first crosspiece 18 of the support structure 17, 18, 19 of each sidepiece 11.

Each connection plate 36 can be provided on each sidepiece 11 disposed protruding toward the opposite sidepiece 11.

Each connection plate 36 can be provided with at least one through hole 37.

According to one embodiment, the connection plates 36 can cooperate with attachment means 38, for example screws or expansion pins, or other means configured to connect the seat 12 to the sidepieces 11 in a selectively releasable manner.

Figure 6:
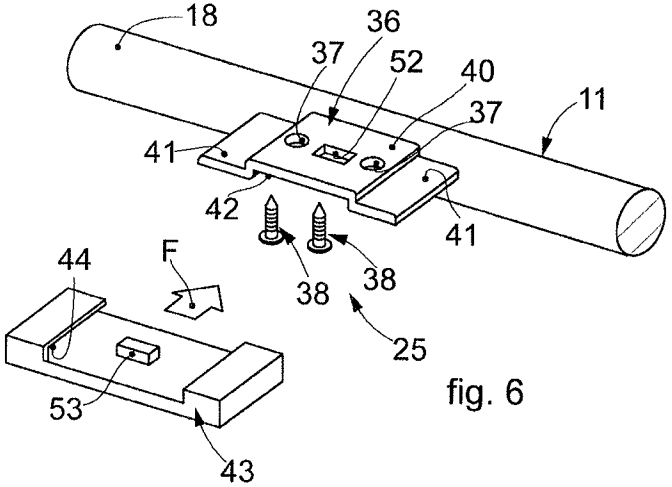
FIG. 6 is a perspective view of another detail of the chair of FIG. 1.
Figure 6A:
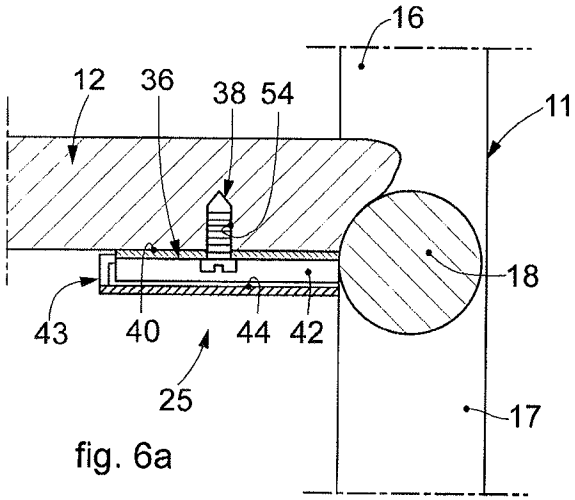
FIG. 6*a* is a section view of the detail of FIG. 6.

In the example of FIG. 6*a*, the seat 12 is disposed resting on the connection plates 36 of both sidepieces 11 and constrained to the connection plates 36 by means of attachment screws 38 inserted in the through holes 37 of the plates 36 and screwed in respective blind holes 54 present in the bottom part of the seat 12.

According to another embodiment, each connection plate 36 can have at least two through holes 37 to increase the safety and stability of the assembly of the seat 12 onto the sidepieces 11.

According to one embodiment, the connection plates 36 can protrude from the sidepiece 11 by a distance comprised between 1 cm and 10 cm, preferably between 2 cm and 6 cm depending on the size of the seat 12 and more generally of the chair 10.

The connection plates 36 can be disassembled from the sidepieces 11, that is connected to the sidepieces 11 by means of a joint, or connected to the sidepieces 11 by means of mechanical attachments.

The connection plates 36 can be welded to the sidepieces 11.

According to one embodiment, each connection plate 36 is provided with at least one flat contact surface 40 on which the through holes 37 are provided and configured to come into contact with the seat 12. In this way the seat 12 abuts on the maximum possible contact surface of the connection plate 36.

According to another embodiment, the connection plates 36 have at least one variation in planarity with, for example, a stepped development, centrally raising the flat contact surface 40 with respect to two lateral surfaces 41.

According to one embodiment, the lateral surfaces 41 are configured to not come into contact with the seat 12.

According to another embodiment, with reference to FIG. 6, the flat contact surface 40 can be raised with respect to the two lateral surfaces 41 so as to define a hollow 42 between them and below the flat contact surface 40.

The hollow 42 can advantageously accommodate the protruding parts of the attachment means 38, for example the heads of attachment screws, preventing the latter from protruding dangerously from the seat 12.

According to another embodiment, during use a covering element 43 configured to cover the protruding parts of the attachment means 38, for example the heads of attachment screws, can be applied to the connection plates 36. In this way the attachment means 38 are completely covered preventing possible dangers for the user and improving the overall aesthetic appearance of the chair 10.

Advantageously the covering element 43 can be applied to the connection plate 36 once the seat 12 is firmly assembled onto the sidepieces 11, that is when the connection plates 36 as above cooperate with the attachment means 38. In this way the covering element 43 can be easily inserted and, if necessary, replaced without needing to disassemble the chair 10 again. Furthermore, the covering element 43 prevents the user from coming into direct contact with the protruding parts of the attachment means 38, thus preventing possible injuries to the user, and at the same time allows to store the chairs 10 by stacking them without damaging the seats 12 and the sidepieces 11 of each stacked chair 10.

With reference to FIG. 6, the covering element 43 can have a box-like shape having at least one housing seating 44 with a shape complementary to the shape of the connection plate 36. In this way the covering element 43 can be associated with the connection plate 36 according to the direction of the arrow F, so that the connection plate 36 slides in the housing seating 44 as above.

According to one embodiment, the housing seating 44 of the covering element 43 is configured to surround and retain the lateral surfaces 41. In this way the covering element 43 connects to the connection plate 36 easily and quickly.

The covering element 43 is configured to cover the entire lower surface of the connection plate 36, from which the attachment means 38 protrude, for example the heads of the screws.

The covering element 43, for example, can be advantageously made of plastic or silicone, rubber or felt so as to be easily inserted on the connection plate 36 and not damage the seat 12 of a chair 10 when it is stacked under another chair 10.

According to one embodiment, the covering element 43 can be configured to cover the hollow 42.

As shown by way of example in FIGS. 6-6*a*, the housing seating 44 can be configured to engage by sliding only the lateral surfaces 41 of the connection plate 36 and thus cover the possible hollow 42 provided in the connection plate 36. In this way the flat contact surface 40 is not covered so as to guarantee the direct abutment between the flat contact surface 40 and the seat 12.

According to one embodiment, the covering elements 43 are provided with at least one insertion seating 52 configured to receive, by means of a snap-on coupling, a clamping element 53 provided on each covering element 43. Advantageously this snap-on coupling allows to connect the covering elements 43 to the connection plates 36 in a selectively releasable manner.

The insertion seating 52 can be a recess or a concavity suitable to retain the clamping element 53. The insertion seating 52 can be made in the hollow 42.

According to one embodiment, the insertion seating 52 can comprise a through aperture (FIG. 6) in the flat contact surface 40 of the connection plate 36 suitable to allow the insertion of the clamping element 53. This through aperture can be, for example, a square, circular, rectangular or polygonal hole.

The insertion seating 52 can be provided in the flat contact surface 40 between the through holes 37.

According to one embodiment, the clamping element 53 can comprise a mobile pin configured to enter into the insertion seating 52 in a snap-on or jointed manner once the covering element 43 is correctly positioned on the connection plate 36.

According to another embodiment, the clamping element 53 can comprise a retaining tooth.

According to another embodiment, the clamping element 53 can comprise an elastic return element, for example a spring or an element made of partly yielding material.

The clamping element 53 can be positioned in the housing seating 44 of the covering element 43.

According to a possible variant, the insertion seating 52 can be provided on the covering element 43 and the clamping element 53 can be provided on the connection plate 36 so that it is inserted in the insertion seating 52 once the covering element 43 is correctly positioned. According to one embodiment, each sidepiece 11 can be provided with at least two connection plates 36 so as to increase the stability of the support of the seat 12.

Each connection plate 36 of a sidepiece 11 (FIG. 2) can be aligned with a respective opposite connection plate 36 provided on the other facing sidepiece 11. In this way when the chair 10 is in use the loads of the seat 12 and of the user are equally distributed.

According to one embodiment, the seat 12 can be in a single body so as to facilitate the assembly/disassembly operations.

According to a variant, the seat 12 can be made of several bodies, for example slats, each one configured to connect to two pairs of opposite facing connection plates 36 and disposed aligned in order to define the seat 12.

It is clear that modifications and/or additions of parts may be made to the chair 10 as described heretofore, without departing from the field of the present invention.

It is also clear that, although the present invention has been described with reference to some specific examples, a person of skill in the art shall certainly be able to achieve many other equivalent forms of chair 10, having the characteristics as set forth in the claims and hence all coming within the field of protection defined thereby.

What is claimed is:

1. A chair comprising two facing and cooperating sidepieces (11), bar-type connection means to correctly and stably distance the two sidepieces (11), a backrest (13) and a seat (12), said bar-type connection means, said backrest (13) and said seat (12) connecting the two sidepieces (11) transversely in a stable manner, wherein said bar-type connection means comprise a single connection bar (14) that is distanced from said seat (12), and in that said chair can be disassembled and stacked.

2. The chair as in claim 1, wherein the connection bar (14) is made integral with a respective side of each sidepiece (11).

3. The chair as in claim 1, wherein the connection bar (14) is made integral with a respective crosspiece (18, 19) of each sidepiece (11).

4. The chair as in claim 1, wherein the connection bar (14) is made integral with a respective leg (17) of each sidepiece (11).

5. The chair as in claim 1, wherein the connection bar (14) is welded to the sidepieces (11); and wherein said disassembled chair has the seat and the back disassembled from the structure.

6. The chair as in claim 1, wherein the connection bar (14) can be disassembled from the sidepieces (11).

7. The chair as in claim 6, wherein it is provided with connection means (35) present in the sidepieces (11) suitable to associate or disassociate said connection bar (14) with/from said sidepieces (11), said connection means (35) comprising an axial hole (45) provided in each opposite end of the connection bar (14) and a peg (46) provided specular on both sidepieces (11) and configured to cooperate with said axial hole (45).

8. The chair as in claim 7, wherein said connection means (35) comprise a support element (48) protruding from each sidepiece (11), configured to facilitate and support the connection of the connection bar (14) to the sidepieces (11) and provided with stable clamping means (50) to constrain said connection.

9. The chair as in claim 1, wherein it is provided with first engagement/disengagement means (15) to associate or disassociate the backrest (13) with/from the sidepieces (11), which have fixed elements (27, 33, 34) in the backrest (13) which cooperate with one or more mating elements (26, 28, 39) present in an upright (16) of each sidepiece (11) and suitable to connect with said fixed elements (27, 33, 34).

10. The chair as in claim 9, wherein said fixed elements (27, 33, 34) comprise a pin (27) provided facing downward on each side (20) of the backrest (13), said side (20) being suitable to cooperate with the upright (16), and in that said mating elements (26, 28, 39) comprise an axial hole (26) provided at the top of each upright (16) and configured to be selectively coupled with said pin (27).

11. The chair as in claim 9, wherein said mating elements (26, 28, 39) comprise a pin provided facing upward at the top of each upright (16), and in that said fixed elements (27, 33, 34) comprise a hole provided at the bottom of each side (20) of the backrest (13), each of said side (20) being suitable to cooperate with a respective upright (16) and said hole being configured to be selectively coupled with said pin provided on the upright (16).

12. The chair as in claim 9, wherein said fixed elements (27, 33, 34) comprise a recess (33) provided on each opposite side (20) of the backrest (13), in correspondence with where the upright (16) of a respective sidepiece (11) is located, said recess (33) being configured to house and at least partly contain said upright (16).

13. The chair as in claim 9, wherein said mating elements (26, 28, 39) comprise at least one extension (28) provided protruding laterally from each upright (16) and configured to abut against the surface of a lower side (21), facing toward the seat (12), of the backrest (13) and suitable to be associated with the backrest (13).

14. The chair as in claim 9, wherein the mating elements (26, 28, 39) comprise a protrusion (39) provided protruding laterally from each upright (16), and in that said fixed elements (27, 33, 34) comprise a groove (34) provided on each opposite lateral side (20) of the backrest (13) starting from a lower side (21), facing the seat (12), of the backrest (13), said protrusion (39) being configured to cooperate with said groove (34).

15. The chair as in claim 1, wherein the connection bar (14) is made integral with only one respective side of one of the sidepieces (11).

16. A chair comprising two facing and cooperating sidepieces (11), bar-type connection means to correctly and stably distance the two sidepieces (11), and a backrest (13) and a seat (12), said bar-type connection means, said backrest (13) and said seat (12) connecting the two sidepieces (11) transversely in a stable manner, wherein said bar-type connection means comprise a single connection bar (14) that is distanced from said seat (12), and in that said chair can be disassembled and stacked, wherein it is provided with second engagement/disengagement means (25) to stably associate or disassociate the seat (12) with/from the sidepieces (11), said second engagement/disengagement means (25) comprising connection plates (36) which cooperate with attachment means (38) configured to connect the seat (12) in a selectively releasable manner to the sidepieces (11);

wherein said connection plates (36) have a shaping which allows the application of a covering and protection element (43); and wherein said covering and protection elements (43) are connected to the connection plates (36) in a selectively releasable manner by means of snap-on coupling.

* * * * *